US005423407A

United States Patent [19]

Nikolic

[11] Patent Number: 5,423,407

[45] Date of Patent: Jun. 13, 1995

[54] SYSTEMS FOR PROVIDING ELECTRICAL POWER IN RESPONSE TO DEPOSITED COINS

[76] Inventor: Thomas Nikolic, 1065 Grace St. West, Moose Jaw, Saskatchewan S6H-3C2, Canada

[21] Appl. No.: 187,204

[22] Filed: Jan. 27, 1994

[51] Int. Cl.[6] ..... G07F 17/00

[52] U.S. Cl. ..... 194/217; 194/241; 194/904

[58] Field of Search ..... 194/216, 217, 241, 904; 368/90, 108

[56] References Cited

U.S. PATENT DOCUMENTS

| | | | |
|---|---|---|---|
| 3,637,059 | 1/1972 | Schmidt | 194/241 |
| 3,930,363 | 1/1976 | Rubenstein | 194/241 X |
| 4,031,991 | 6/1977 | Malott | 194/217 |
| 4,183,205 | 1/1980 | Kaiser | 368/90 |
| 4,383,210 | 5/1983 | Wilkinson | 194/216 X |
| 4,532,418 | 7/1985 | Meese et al. | 194/904 X |
| 4,676,358 | 6/1987 | Rosendahl | 194/350 X |
| 5,184,707 | 2/1993 | Van Horn et al. | 194/204 |
| 5,263,565 | 11/1993 | Wilkinson | 194/216 |

FOREIGN PATENT DOCUMENTS

| | | | |
|---|---|---|---|
| 793656 | 9/1968 | Canada | 194/241 |
| 0092436 | 10/1983 | European Pat. Off. | 194/217 |
| 2089548 | 6/1982 | United Kingdom | 194/216 |
| 2158308 | 11/1985 | United Kingdom | 194/904 |
| 2187319 | 9/1987 | United Kingdom | 194/217 |

*Primary Examiner*—Michael S. Huppert
*Assistant Examiner*—Scott L. Lowe

[57] ABSTRACT

A system for providing electrical power in response to deposited coins comprising a mounting post secured to the ground, an input head secured at the upper extent of the mounting post, the input head including a plurality of slots for the receipt of coins to be used for the electrical usage to be provided, a plurality of readouts on the input head, an output module located on the post beneath the input head, the output module including a pair of receptacles, the first electrical receptacle adapted for the receipt of a 110 volt plug with a grounding component and the second electrical receptacle adapted for the receipt of a 220 volt plug with a grounding component as well as horizontal and vertical legs and a microprocessor responsive to the inserted coins for illuminating the readouts for indicating information as a function of the coins deposited such as time, money and voltage as well as an output device for supplying voltage for the selected time and voltage.

1 Claim, 3 Drawing Sheets

FIG. 1
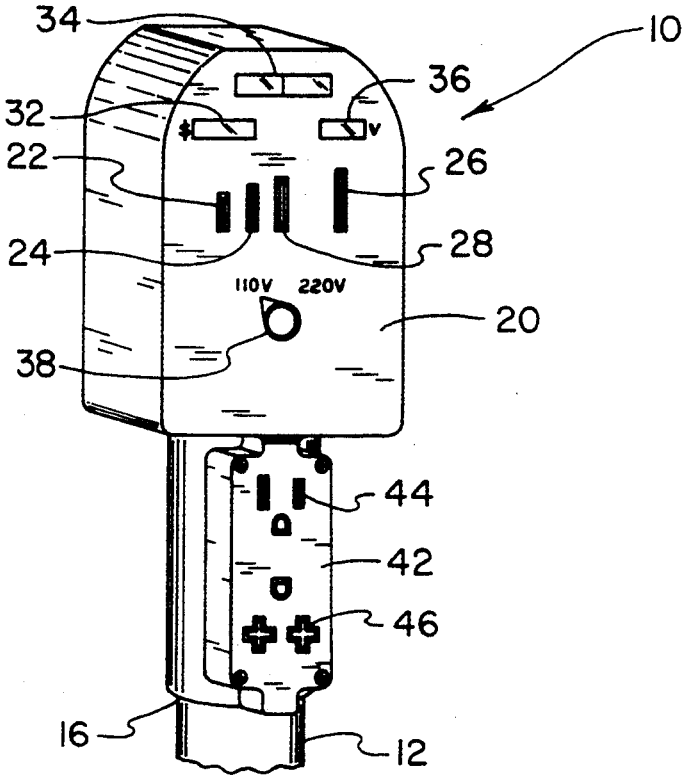
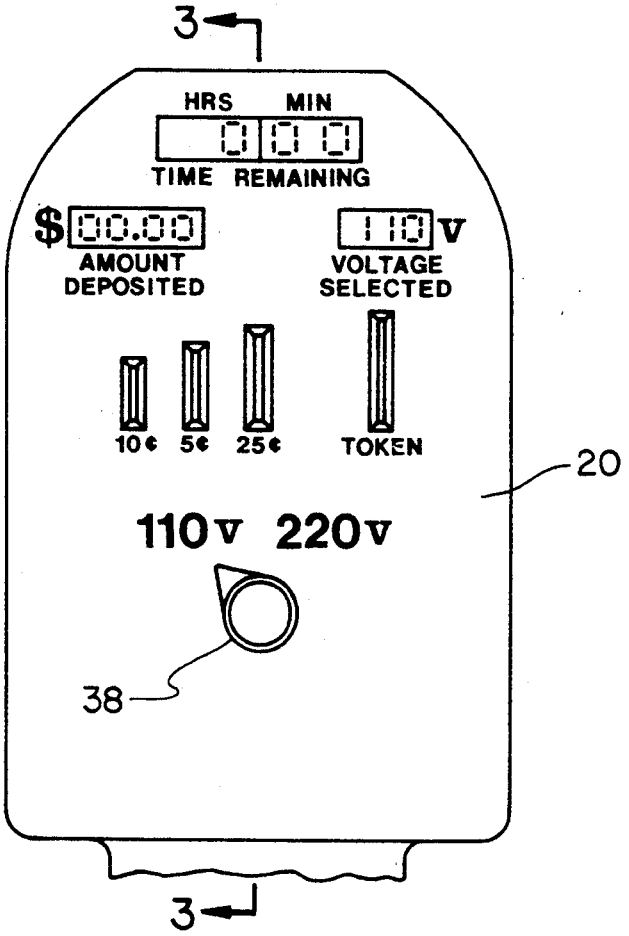
FIG. 2

SYSTEMS FOR PROVIDING ELECTRICAL POWER IN RESPONSE TO DEPOSITED COINS

BACKGROUND OF THE INVENTION

1. Field of the Invention

The present invention relates to a system for providing electrical power in response to deposited coins and more particularly pertains to allowing campers, truckers, motorists or the like to purchase the use of electrical outlets for the amounts of time for which they pay.

2. Description of the Prior Art

The use of electrical outlets is known in the prior art. More specifically, electrical outlets heretofore devised and utilized for the purpose of allowing an electrical hookup at a convenient site are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,637,059 a coin-operated electric power supply station especially adapted for use in remote unsupervised locations.

U.S. Pat. No. 3,930,363 discloses a parking meter which electrically indicates "remaining time" and which electrically operates only in the presence of a vehicle and when there is "paid-for" time on the meter, for example, unused time by one departing motorist is cancelled.

U.S. Pat. No. 4,183,205 discloses an arrangement for resetting a coin operated parking meter by utilizing a sensor to monitor a parking space by determining when a vehicle leaves the parking space with parking time remaining.

U.S. Pat. No. 4,532,418 discloses a structure for and method of charging an electric vehicle at a parking location and facilitating billing for the charging energy utilized and the parking time.

U.S. Pat. No. 4,676,358 discloses a coin control system for determining whether proper coinage has been inserted to start a coin operated device.

Lastly, U.S. Pat. No. 5,184,707 also discloses a parking meter system.

In this respect, the System for providing electrical power in response to deposited coins according to the present invention substantially departs from the conventional concepts and designs of the prior art, and in doing so provides an apparatus primarily developed for the purpose of allowing campers, truckers or the like to purchase the use of electrical outlets.

Therefore, it can be appreciated that there exists a continuing need for new and improved system for providing electrical power in response to deposited coins which can be used for allowing campers, truckers or the like to purchase the use of electrical outlets for the amounts of time they pay for. In this regard, the present invention substantially fulfills this need.

SUMMARY OF THE INVENTION

In view of the foregoing disadvantages inherent in the known types of electrical outlets now present in the prior art, the present invention provides an improved system for providing electrical power in response to deposited coins. As such, the general purpose of the present invention, which will be described subsequently in greater detail, is to provide a new and improved System for providing electrical power in response to deposited coins and method which has all the advantages of the prior art and none of the disadvantages.

To attain this, the present invention essentially comprises a new and improved system for providing a predetermined amount of electrical power in response to a deposited coin comprising a mounting post secured to the ground. An input head is secured at the upper extent of the mounting post. The input head includes a plurality of slots for the receipt of coins to be used for the electrical usage to be provided. A plurality of readouts on the input head indicate the amount of coins deposited, the time of electrical usage remaining for the deposited coins and the selected voltage and a switch for the selection of 110 voltage or 220 voltage. An output module is located on the post beneath the input head. The output module includes a pair of receptacles. The first electrical receptacle is adapted for the receipt of a 110 volt plug with a grounding component and the second electrical receptacle is adapted for the receipt of a 220 volt plug with a grounding component as well as horizontal and vertical legs. A microprocessor responds to the inserted coins for illuminating the readouts for indicating time, money and voltage as well as an output device for supplying electrical current for the selected voltage and desired time.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved system for providing electrical power in response to deposited coins which have all the advantages of the prior art electrical outlets and none of the disadvantages.

It is another object of the present invention to provide new and improved system for providing electrical power in response to deposited coins which may be easily and efficiently manufactured and marketed.

It is further object of the present invention to provide new and improved system for providing electrical power in response to deposited coins which are of durable and reliable constructions.

An even further object of the present invention is to provide new and improved system for providing electrical power in response to deposited coins which are susceptible of a low cost of manufacture with regard to both materials and labor, and which accordingly are then susceptible of low prices of sale to the consuming public, thereby making such system for providing electrical power in response to deposited coins economically available to the buying public.

Still yet another object of the present invention is to provide new and improved system for providing electrical power in response to deposited coins which provide in the apparatuses and methods of the prior art some of the advantages thereof, while simultaneously overcoming some of the disadvantages normally associated therewith.

Still another object of the present invention is to allow campers, truckers, motorists or the like to purchase the use of electrical outlets.

Lastly, it is an object of the present invention to provide new and improved system for providing electrical power in response to deposited coins comprising a mounting post secured to the ground, an input head secured at the upper extent of the mounting post, the input head including a plurality of slots for the receipt of coins to be used for the electrical usage to be provided, a plurality of readouts on the input head, an output module located on the post beneath the input head, the output module including a pair of receptacles, the first electrical receptacle adapted for the receipt of a 110 volt plug with a grounding component and the second electrical receptacle adapted for the receipt of a 220 volt plug with a grounding component as well as horizontal and vertical legs and a microprocessor responsive to the inserted coins for illuminating the readouts for indicating information as a function of the coins deposited such as time, money and voltage as well as an output device for supplying voltage for the selected time and voltage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the new and improved system for providing electrical power in response to deposited coins constructed in accordance with the principles of the present invention.

FIG. 2 is an ,enlarged elevational view of the upper portion of the device shown in FIG. 1.

The same reference numerals refer to the same parts through the various Figures.

DESCRIPTION OF THE PREFERRED EMBODIMENT

Figure 3:
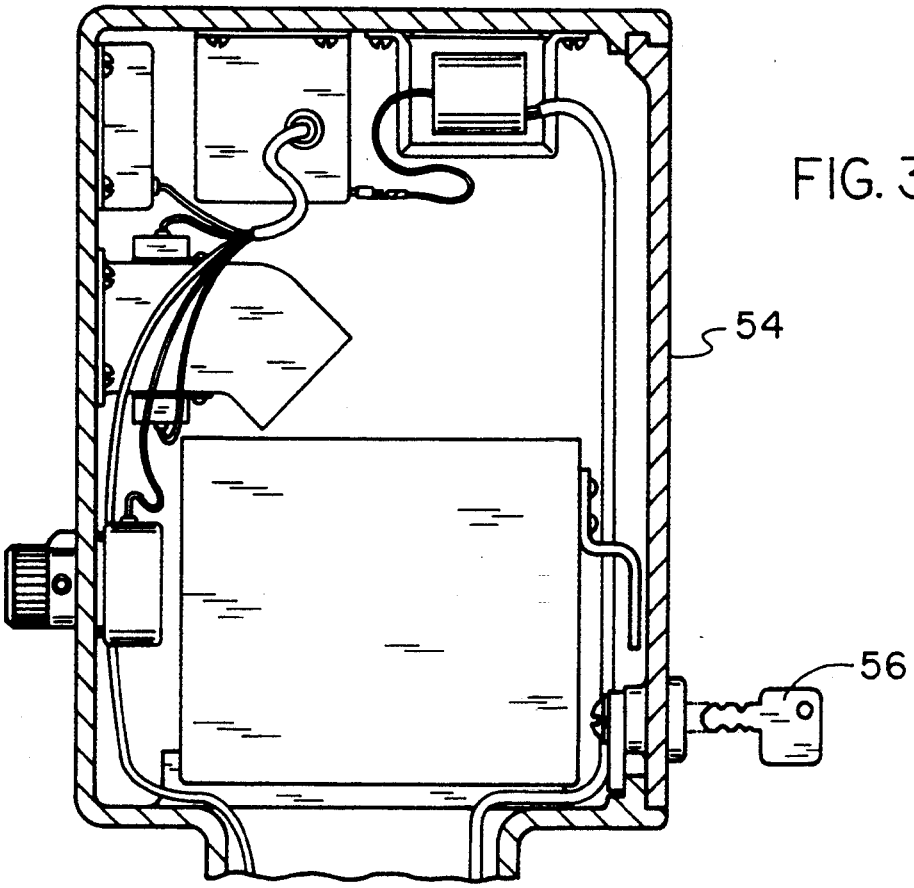
FIG. 3 is a cross-sectional view taken along lines 3—3 of FIG. 2.
Figure 4:
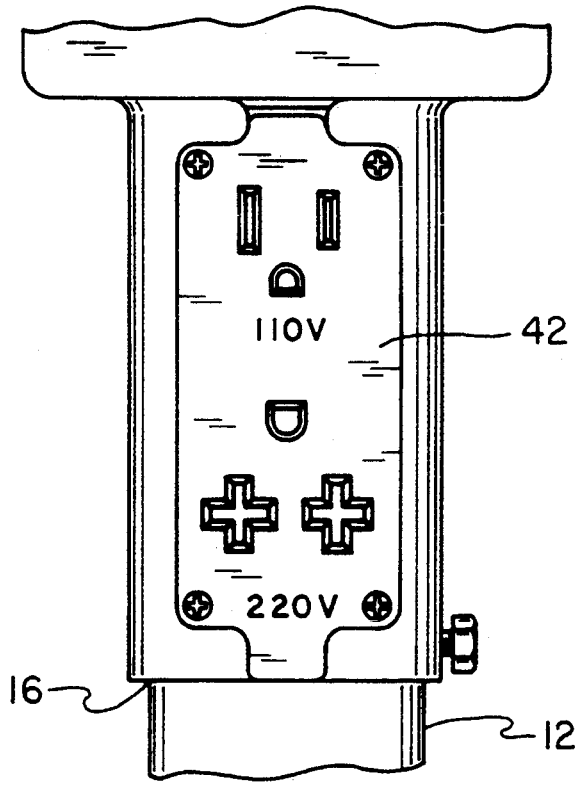
FIG. 4 is an enlarged elevational view of the lower portion of the device shown in FIG. 1.
Figure 5:
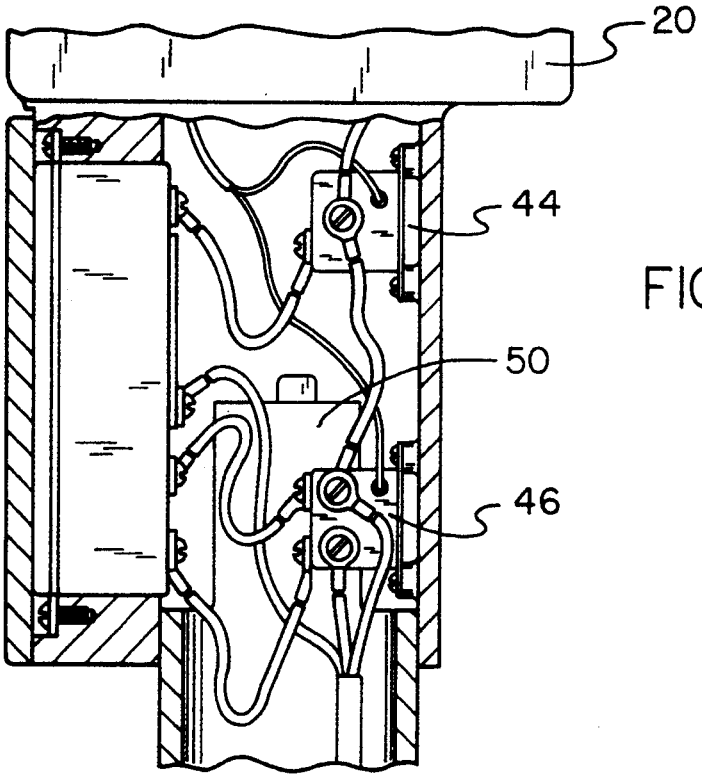
FIG. 5 is a cross-sectional view taken through the components shown in FIG. 4.
Figure 6:
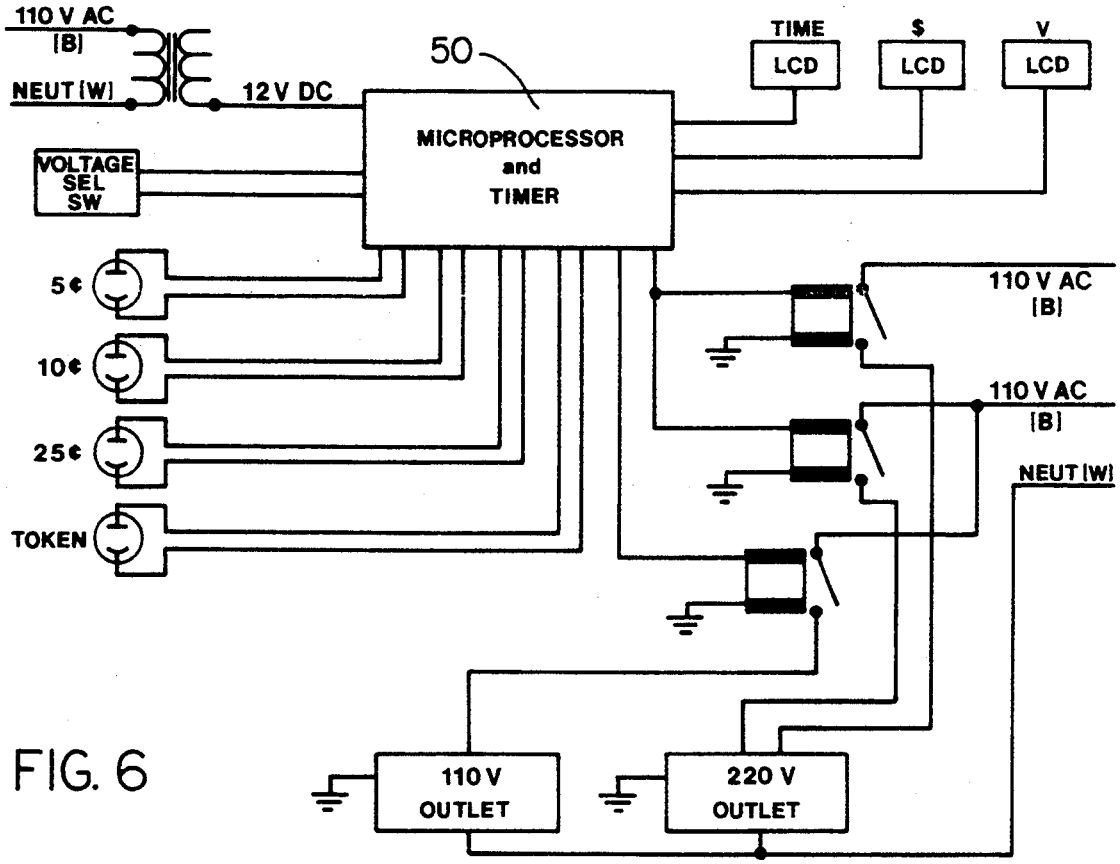
FIG. 6 is an electrical schematic of the device shown in the prior Figure.

With reference now to the drawings, and in particular to FIG. 1 thereof, the preferred embodiment of the new and improved system for providing electrical power in response to deposited coins embodying the principles and concepts of the present invention and generally designated by the reference numeral 10 will be described.

The present invention, the new and improved system for providing electrical power in response to deposited coins, is a system 10 comprised of a plurality of components. In its broadest context, such components, include a mounting post, an input head, a plurality of readouts, an output module and a microprocessor. These components are individually constructed and correlated one with respect to the other to most efficiently carry out the intended object.

More specifically, the central component of system is a mounting post 12. Such mounting post 12 is simply a support member secured at its lower end to the ground or other surface and with its upper end 16 adapted to support the other operational components of the system.

Located at the upper end 16 is the input head 20. The input head 20 is secured to the mounting post in a permanent relationship. Such input head 20 includes a plurality of slots 22, 24, 26 and 28. Such slots are adapted for the receipt of coins, as for example, slots for a nickel, dime and quarter. The fourth slot 28 is adapted to receive a token that might be utilized at the facility employing the system 10 of the present invention. The name of the coin to be deposited into the appropriate slot is written adjacent to such slots. The coins inserted into the slots are adapted to be used for determining the extent of the electrical energy to be provided when using the present system.

Next provided are a plurality of readouts 32, 34 and 36. Such readouts are printed on the input head 20. The function of the readouts is to indicate different types of information including the amount of coins deposited, the time of electrical usage remaining for the previously deposited coins and, an indication of the selected voltage. In association therewith, a switch 38 is provided for being pivoted to one position or the other to point to the 110 or 220 as an indication of the voltage to be selected.

Next provided is an output module 42. The output module 42 is located at the upper edge of the mounting post 12. It is located immediately beneath the input head 20. The output module 42 includes a pair of electrical receptacles 44 and 46. The first receptacle 44 is adapted for the receipt of a 110 volt plug with a grounding component in the conventional configuration. The second electrical receptacle 46 is adapted for the receipt of a 220 volt plug with a grounding component as well as horizontal and vertical legs.

The last and functionally central component of the system 10 is a microprocessor 50. The microprocessor 50 is adapted to receive input from the coins deposited and from the positioning of the switch. In response thereto, the readouts are illuminated for indicating the time of electrical usage remaining, the money deposited, and the voltage being supplied. In response to the inserted coins and the information on the readouts, the output device will supply electrical current for the user through the plug inserted in the receptacle corresponding to the selected voltage type. In this manner, during operation and use, the present system 10 will provide the desired time and voltage for current to be utilized for any purpose desired by the user.

A door 54 on the back of the input head 20 may be opened by a key 56 to allow collecting the money therefrom.

The present invention is a power timer that operates in the same fashion that a parking meter operates. The owner would have to run the appropriate electrical lines underground and up to and through the power timer. On the end of each meter, there would be a male/female socket that would connect to the electrical wire. The meter head would correspond with the amount of time along with the amount of money. For example, one dollar would allow the switch to be turned to the position that equals one hour. The relay would then start and continue until the switch "clicked" back to the starting position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved system for providing a predetermined amount of electrical power in response to a deposited coin comprising, in combination:

a mounting post secured to the ground;

an input head secured at the upper extent of the mounting post, the input head including a plurality of slots for the receipt of coins to be used for the electrical usage to be provided and a door secured thereto and openable with a key for collecting coins therefrom;

a plurality of readouts coupled to the input head to indicate the amount of coins deposited, the time of electrical usage remaining for the deposited coins and a selected voltage, and a switch for selection of 110 voltage or 220 voltage;

an output module located on the post beneath the input head, the output module including a pair of electrical receptacles, the first electrical receptacle rated at 110 volts and having three wires for the receipt of a 110 volt plug with two prongs and a grounding component and the second electrical receptacle rated up to 220 volts and having three wires for the receipt of either a 220 volt plug with a grounding component and a horizontal and a vertical leg, or a 110 volt plug with a grounding component and two vertical legs; and a microprocessor responsive to the inserted coins for illuminating the readouts for indicating time, money, and voltage, as well as, an output device formed of three power delivery switches coupled to the output module and coupleable to an external source of electrical power for supplying electrical power to the electrical receptacles at the selected voltage for a time as determined by the amount of coins deposited.

* * * * *